US007557778B2

(12) United States Patent
Le Roy et al.

(10) Patent No.: US 7,557,778 B2
(45) Date of Patent: Jul. 7, 2009

(54) DISPLAY DEVICE AND CONTROL CIRCUIT FOR A LIGHT MODULATOR

(75) Inventors: Philippe Le Roy, Betton (FR); Christophe Prat, Nantes (FR); Christophe Fery, Rennes (FR)

(73) Assignee: Thomson Licensing, Boulogne Billancourt (FR)

( * ) Notice: Subject to any disclaimer, the term of this patent is extended or adjusted under 35 U.S.C. 154(b) by 408 days.

(21) Appl. No.: 10/562,805

(22) PCT Filed: Jun. 25, 2004

(86) PCT No.: PCT/FR2004/001629

§ 371 (c)(1),
(2), (4) Date: Jun. 19, 2006

(87) PCT Pub. No.: WO2005/013250

PCT Pub. Date: Feb. 10, 2005

(65) Prior Publication Data

US 2007/0057874 A1 Mar. 15, 2007

(30) Foreign Application Priority Data

Jul. 3, 2003 (FR) ..... 03 08127

(51) Int. Cl.
*G09G 3/30* (2006.01)

(52) U.S. Cl. ..... 345/76; 345/82; 345/84; 345/87

(58) Field of Classification Search ..... 345/42, 345/45–46, 48, 76–79, 84, 87–102, 204, 345/209–211, 214; 327/100–108; 315/169.3
See application file for complete search history.

(56) References Cited

U.S. PATENT DOCUMENTS

2002/0047817 A1 4/2002 Tam
2002/0101172 A1 8/2002 Bu

FOREIGN PATENT DOCUMENTS

EP 1381019 1/2004
WO WO 02/071379 9/2002

OTHER PUBLICATIONS

Search Report Dated Nov. 30, 2004.

*Primary Examiner*—Richard Hjerpe
*Assistant Examiner*—Mansour M Said
(74) *Attorney, Agent, or Firm*—Robert D. Shedd; Harvey D. Fried; Patricia Verlangieri

(57) ABSTRACT

The invention relates to an active-matrix image display device that comprises an array of light emitters. Each light emitter is controlled by a current modulator having a particular trip threshold voltage. The device also includes compensation means for compensating for the trip threshold voltage of the modulators. These compensation means comprise at least one operational amplifier connected between the gate electrode and the source electrode of the modulator. The feedback of this operational amplifier compensates for the trip threshold voltage of at least one modulator whatever the value of the said voltage.

9 Claims, 3 Drawing Sheets

DISPLAY DEVICE AND CONTROL CIRCUIT FOR A LIGHT MODULATOR

The present invention relates to an active-matrix image display device.

Flat image display screens are increasingly used in all kinds of applications, such as in motor-vehicle display devices, digital cameras or mobile telephones.

Displays in which the light emitters are formed from organic electroluminescent cells, such as OLED (organic light-emitting diode) displays, are known.

In particular, passive-matrix OLED-type displays are already widely available commercially. However, they consume a large amount of electrical energy and have a short lifetime.

Active-matrix OLED displays include built-in electronics and have many advantages, such as reduced consumption, high resolution, compatibility with video rates, and a longer lifetime than passive-matrix OLED displays.

Conventionally, active-matrix display devices comprise a display panel formed especially by an array of light emitters. Each light emitter is associated with a pixel or with a subpixel of an image to be displayed and is addressed by an array of column electrodes and an array of row electrodes via an address circuit.

FIG. 1 shows a lighter emitter E, hereafter referred to as an emitter, and the address circuit associated with it. More precisely, this is a voltage address circuit.

Typically, an address circuit of this type comprises means for controlling and means for supplying the emitter. It is controlled via an array of row electrodes and an array of column electrodes. These electrodes are used to select and then address a specific emitter E from all the emitters of the display panel.

The emitter address means comprise a control switch 11, a storage capacitor C and a current modulator M.

The modulator M converts a data control voltage for a pixel or subpixel into an electrical current flowing through it. In general, the modulator M is a transistor component of the n- or p-MOSFET type. Such components have three terminals, namely a drain and a source, between which the modulated current flows, and a gate to which the control voltage is applied.

When the modulator is of the n-type as shown in FIG. 1, the modulated electrical current flows between the drain and the source; when it is of the p-type, the modulated electrical current flows between the source and the drain. The modulator M is connected in series with the emitter. The two terminals of this series are connected to supply means, the anode terminal to a supply electrode $V_{dd}$ and the cathode terminal generally to an earth electrode.

In the case in FIG. 1 of OLED displays of conventional structure, it is the anode of the emitters that forms the interface with the active matrix: the drain (n-type case) or the source (p-type case) of the modulators is then connected to the supply electrode $V_{dd}$, and the cathode of the emitters is connected to the earth electrode.

In the case (not shown) of OLED displays with what is called the reverse structure, it is the cathode of the emitters that forms the interface with the active matrix: the source (n-type case) or the drain (p-type case) of the modulators is then connected to the earth electrode and the anode of the emitters is connected to the supply electrode $V_{dd}$.

When the modulator M is selected by the control switch I1, a video data voltage $V_{data}$ is applied to the gate of the modulator M. When the modulator M is considered to be operating in the saturation region, this modulator generates a drain current that conventionally varies as a quadratic function of the potential difference applied between the gate and the source of the modulator.

Preferably, since the light emitters of the panel are arranged in rows and columns, all the control switches I1 of the emitters of one and the same row are controlled by what is called a row electrode and all the video data signal inputs of the control switches I1 of the emitters of one and the same column are supplied by what is called a column electrode.

When it is desired to address a light emitter, a control voltage is applied to the row electrode $V_{select}$ connected to the gate of the control switch I1 of this emitter in order to select the said emitter. The switch I1 is turned on and the data voltage $V_{data}$ present on the column electrode is then applied to the gate of the modulator M.

The means for addressing a light emitter comprise a storage capacitor C connected between the gate of the modulator and the supply voltage $V_{dd}$ applied to this emitter via the modulator. This storage capacitor C stores the voltage applied to the gate of the modulator in order for the light energy of the emitter to be maintained approximately constant over the duration of the image frame, even when the control switch for this emitter is no longer closed and the corresponding row is no longer selected.

In an active-matrix device for an OLED display, the control switch I1 and the modulator M are thin-film transistors, also called TFTs.

The fabrication of these components deposited as thin films on a glass substrate is usually based on low-temperature polysilicon (LTPS) technology. This technique uses a laser whose purpose is to transform the amorphous silicon into polysilicon. During the laser pulse, the amorphous silicon, which is rapidly heated, ends up being melted and it is during the cooling phase that the process of crystallizing the amorphous silicon into polysilicon takes place.

However, this crystallization process introduces local spatial variations in the trip threshold voltage of the polysilicon thin-film transistors. These variations are due to the fact that the polysilicon grain boundaries and sizes cannot be controlled sufficiently during the crystallization phase.

FIG. 2 shows the variations in the drain current $I_d$ as a function of the applied gate-source voltage $V_{gs}$ for various polysilicon thin-film transistors. It may be seen in this figure that the trip threshold voltage $V_{th}$ of these transistors varies from one transistor to another and exhibits a dispersion in the values owing to the defects caused by the variations induced by the transistor crystallizaton process.

To allow the drain current to flow, the gate-source voltage $V_{gs}$ of the modulator must be greater than the trip threshold voltage $V_{th}$ of the modulator formed by one of the aforementioned transistors.

As a corollary, the drain current flowing through such thin-film transistors varies with the trip threshold voltage of these transistors. This is because, when a thin-film transistor operates in saturation mode, it operates as a current generator. The imposed drain current that it delivers to the emitter varies according to the following equation:

$$I_c = K(V_{gs} - V_{th})^2$$

where K=kW/2L, and in which:

$V_{gs}$ corresponds to the applied gate-source voltage of this transistor, this voltage also being called the setpoint voltage, $V_{th}$ corresponds to the trip threshold voltage of this transistor, W and L correspond respectively to the width and to the length of the channel of the transistor, k is a constant that depends on the type of technology employed for fabricating the transistor.

Thus, as the curves shown in FIG. 2 confirm, in saturation mode the drain current varies from one transistor to another depending on the trip threshold voltage of each transistor.

Consequently, the polysilicon modulators M making up any one display panel and supplied by the same supply voltage $V_{dd}$ will generate currents of different intensity, even when these modulators are controlled by identical data voltages $V_{data}$.

Now, an emitter E generally emits a light intensity directly proportional to the current that flows through it, so that the non-uniformity of the trip thresholds of the polysilicon transistors leads to brightness non-uniformity of a display formed by a matrix of such transistors. This results in differences between the luminance levels and manifest visual discomfort for the user.

To limit this discomfort, various circuits for compensating for the variation in trip threshold voltage have been proposed.

Thus, a first method, called digital control method, consists in reducing the degradation in the luminance levels by modifying the structures of the pixels. However, this method consumes energy and requires a high-speed address circuit.

Another method, described in the Sony document *"A 13-inch AMOLED display"*, SID Digest, 2001, consists in current-programming the pixel structures. This mode of addressing compensates both for the variations in mobility of the charge carriers and therefore in the threshold voltage. However, the current-programming must take into account very low current levels for low luminance, which considerably increases the programming time needed to establish the suitable current delivered to the OLED light emitter. In addition, each address circuit produced using this method requires the implantation of four TFTs per emitter. This method is not very economical and considerably reduces the useful light emission area of the pixels.

Another method described in the document "Seoul National University, AM-LCD 02, OLED-2, page. 13" achieves voltage compensation by a voltage address circuit that comprises two additional TFTs. These transistors are connected between the control switch I1 and the current modulator M. This other method is based on the principle whereby the voltage threshold of the first additional transistor and of the modulator M are identical since, during their fabrication, these components are parallel to the scan direction of the laser beam used to heat the thin film to be recrystallized and thus are subjected substantially to the same recrystallization conditions. In such an address circuit, the trip threshold voltage of the first additional transistor automatically compensates for the trip voltage of the modulator so that the drain current supplying the emitter is independent of the trip voltage. It should be noted that the second thin-film transistor also allows the voltage stored in the charging capacitor to be reset.

However, the address circuit in that method also requires the production of a four-transistor address circuit. This greater complexity reduces both the reliability and the yield of displays, leading to a substantial increase in fabrication costs.

Another method is described in the document EP 1 381 019, especially in paragraphs 42 and 43 with reference to FIGS. 7 and 11 of that document; the voltage control method described here uses an operational amplifier 54 to compensate for the variations in trip threshold of all the modulators 32 relating to the same column of pixels; the output of this amplifier is connected, via the switch SW2*a* and the electrode Xi, to the gate G of the modulator 32; the non-inverting input (+) of this amplifier is connected, via the resistor 52, the switch SW1*a* and the electrode Wi, to the drain electrode D of this modulator 32.

It has been observed that the operational amplifier connected in this way operates in fact not really as described in that document, but as a hysteresis comparator, also commonly called a "Schmitt trigger", which amounts to controlling the emitters of the display in "on/off" digital mode, that is to say in bistable mode; the grey levels can then be obtained only by PWM (pulse-width modulation), which poses other display quality problems, such as contouring. Moreover, such a set-up requires many switches with their corresponding drive means, which is expensive.

In the document US 2002/047817, which describes a circuit for controlling a current modulator T2, which also includes an operational amplifier, which is used here as comparator between a voltage ramp $V_{DRV}$ and a data voltage $V_{DAT}$, so as to program the open time of the modulator T2, as indicated especially in paragraph 14 of that document, especially the last phrase, there are therefore the abovementioned drawbacks of PWM; it should also be noted that the operational amplifier exhibits no feedback in such a set-up.

It is an object of the present invention to provide an active-matrix image display device in which the trip threshold voltages of polysilicon transistors are automatically compensated for and in which the drawbacks of the methods of the prior art are absent.

For this purpose, the subject of the present invention is an active-matrix image display device comprising:

several light emitters forming an array of emitters distributed in rows and in columns, means for controlling the emission of the light emitters of the array, comprising:

for each light emitter of the array, a current modulator capable of controlling the said emitter, and comprising a source electrode, a drain electrode, a gate electrode and a trip threshold voltage ($V_{th}$), the trip threshold voltage varying from one modulator to another, column address means capable of addressing the emitters of each column of emitters by applying a data voltage to the gate electrode of their modulators in order to control them, row select means capable of selecting the emitters of each row of emitters by applying a select voltage, compensation means for compensating for the trip threshold voltage of each modulator, characterized in that:

the compensation means comprise at least one operational amplifier, the feedback of this operational amplifier being capable of compensating for the trip threshold voltage of at least one modulator whatever the value of the said voltage, and the said amplifier having an inverting input (−), a non-inverting input (+) and an output terminal, and the non-inverting input (+) of the operational amplifier being connected to a column address means controlling the said modulator, and the inverting input (−) of the operational amplifier being connected to the source electrode of the said modulator, and the output of the operational amplifier being connected to the gate electrode of the said modulator.

According to particular embodiments of the invention, the display device includes one or more of the following features:

the control means comprise, for the said modulator associated with an emitter, at least a first control switch connected between the output of the operational amplifier and the gate electrode of the said modulator, the first switch having a gate electrode capable of receiving the row select voltage for this emitter; and the control means comprise, for the said modulator associated with an emitter, a second control switch connected between the inverting terminal of the operational amplifier and the source electrode of the modulator, the second switch having a gate electrode connected to the gate electrode of the said first switch in order to receive, synchronously, the select voltage; and the row select means are capable of supplying a gate electrode of at least one of the said first switches in order to select at least one emitter in this row; and the compensation means comprise an operational amplifier capable of compensating for the trip threshold voltage of all of the modulators controlling the emitters of a column; and the modulators and the first and second control switches are components fabricated in thin-film polysilicon or thin-film amorphous silicon; and the modulators are n-type transistors and their drain is supplied by a supply means; and the modulators are p-type transistors and the control means furthermore include a passive component placed between the source and a supply electrode of the modulator; and each emitter is an organic light-emitting diode; and the passive component comprises a thin-film resistor; and the control means further include at least one charging capacitor connected between the gate electrode and the source electrode of the said modulator in order to maintain the brightness of a pixel or of a subpixel over the duration of an image frame; and the control means include a compensating capacitor connected between the output and the inverting input of the operational amplifier in order to voltage-stabilize the active matrix; and the drain current of a modulator depends on the difference between the supply voltage for the modulator and the potential difference between the gate and the source of the modulator; and the compensation means comprise several operational amplifiers, each operational amplifier being capable of compensating for the trip threshold voltage of a modulator controlling an emitter.

The device according to the present invention advantageously makes it possible to compensate for the brightness variations that are due to the local spatial variations in the polysilicon components. As a consequence, it considerably improves the uniformity of the images.

In addition, each address circuit for a light emitter advantageously comprises only three thin-film transistors. This image display device is consequently simpler to fabricate and occupies a smaller useful area of the pixel, resulting in a higher open aperture ratio of the said pixel.

In addition, its fabrication is less expensive as it requires less silicon. This is because, considering the number of emitters forming a display panel, the saving of one transistor per emitter represents a substantial saving, increasing fabrication yield.

Another object of this invention is to propose a circuit for controlling a current modulator that can, for example, be used in an active-matrix image display device.

For this purpose, the invention provides a circuit for controlling a current modulator having an undefined trip threshold voltage, the circuit including trip threshold voltage compensation means, characterized in that the trip threshold voltage compensation means comprise at least one operational amplifier, connected between a gate electrode and a source electrode of the said modulator, and the feedback of which compensates for the trip threshold voltage of the modulator so that the intensity of the drain current flowing through the modulator is independent of the trip threshold voltage of the modulator. Preferably, the output of this operational amplifier is connected to the gate electrode of the modulator and its inverting input (−) is connected to the source electrode of this same modulator.

The invention will be more clearly understood on reading the description that follows, given by way of non-limiting example and with reference to the appended figures in which:

FIG. 3 shows an element of an image display device according to a first embodiment of the present invention. This element comprises a light emitter E and the address circuit 10 associated with it.

Figure 1:
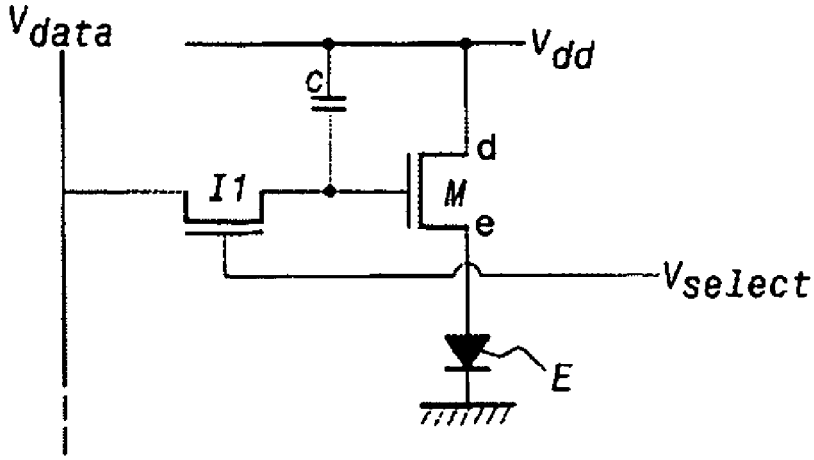
FIG. 1 is a schematic diagram of a light emitter address circuit known from the prior art.
Figure 2:
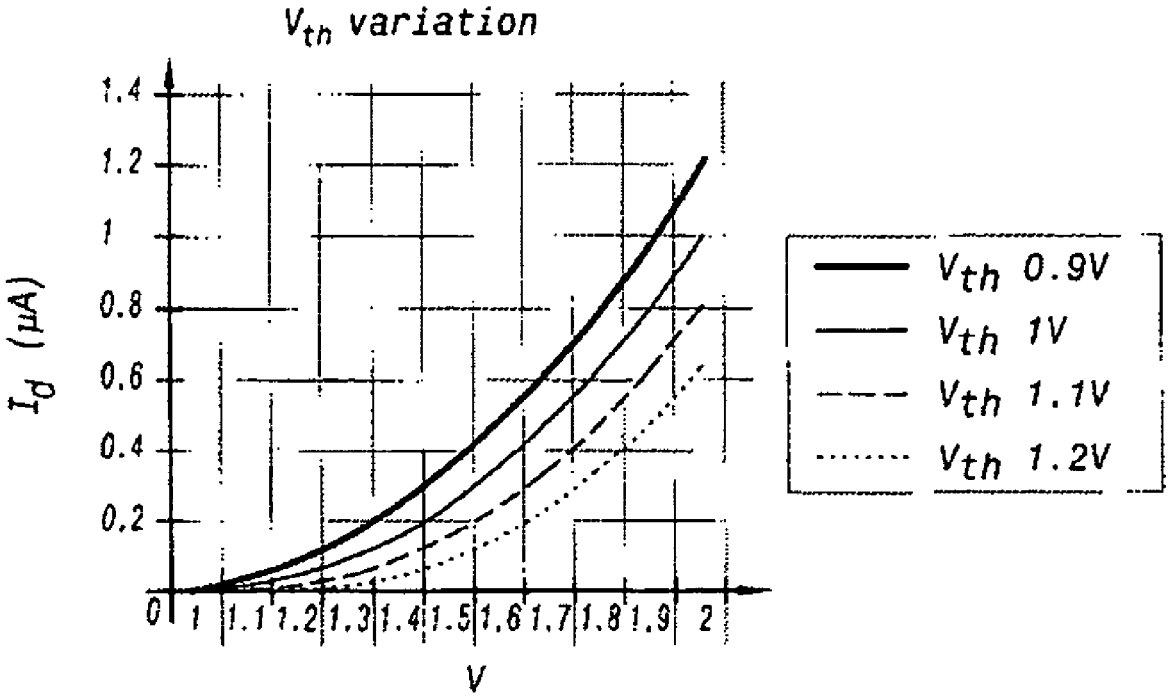
FIG. 2 is a graph showing curves of the current-voltage characteristic of various thin-film transistors fabricated by the technique, known per se, of low-temperature polysilicon (LTPS) crystallization.

Conventionally, this address circuit 10 comprises a current modulator M, a first control switch I1, a storage capacitor C, a row select electrode $V_{select}$, a column address electrode $V_{data}$ and a voltage supply electrode $V_{dd}$.

In the example shown, the modulator is of the n-type and the emitter is a diode of the OLED type with conventional structure. The same circuit is also applicable to OLED displays with an inverted structure provided that p-type modulators are used and the modulator-emitter series is inverted, that is to say the anode of the emitters is connected to the supply electrode $V_{dd}$ and the drain of the modulators to the earth electrode.

Subsequently, another circuit suitable for the use of a p-type modulator with a conventional OLED structure, which is also applicable to an n-type modulator with an inverted OLED structure, will be presented with reference to FIG. 4.

A supply source $V_{dd}$ is connected to the drain of the modulator M. When a data voltage $V_{data}$ is applied to the gate of this modulator M, a setpoint current, also called a drain current, is established between the drain and the source and this supplies the anode of the light emitter E.

The intensity of this drain current depends, interalia, on the trip threshold voltage $V_{th}$ of the modulator transistor. The light emitter E emits an amount of light proportional to this current. The same data voltage therefore does not generate the same amount of light from one emitter to another.

To compensate for the variations in luminance that are induced by the local spatial variations in the threshold voltages, the address circuit according to the present invention includes an operational amplifier 11, which compensates for the trip threshold voltage $V_{th}$ of the current modulators M.

In practice, the column address electrode here is connected to the non-inverting input (+) of the operational amplifier 11. The source of the modulator M is connected to the inverting terminal (−) of the operational amplifier, and the output terminal of the operational amplifier 11 is connected to the gate of the modulator M in order to turn it on by applying the control voltage.

Preferably, a selection switch I1 is connected in series between the gate of the modulator M and the output terminal of the operational amplifier 11 and a switch I2 is connected in series between the source of the modulator and the inverting terminal (−) of the operational amplifier, and the control for these switches I1, I2 are connected to the same row select electrode $V_{select}$.

In this structure, the feedback thus obtained from the operational amplifier advantageously compensates for the trip threshold voltage $V_{th}$ of the modulator M, and does so whatever the value of this voltage.

Thus, because of the feedback of the operational amplifier, the voltage of the anode of the emitter E is also equal to the column data voltage $V_{data}$ and the drain current emitted by the modulator and passing through the emitter is independent of the trip threshold voltage $V_{th}$ of the modulator M. The gate-source voltage, which is generated by the operational amplifier, compensates for the threshold voltage of the modulator M whatever its value. Thus, we have here a current generator controlled by the data voltage $V_{data}$ on the basis of an equivalent diode load, which is not fixed.

In addition, the application of a feedback of the trip threshold voltage is advantageously synchronous with the application of the data control voltage $V_{data}$ and of the select control voltage $V_{select}$.

Advantageously, this address circuit also includes a first control switch I1, which is turned on and off by the row control electrode. This first switch I1 is connected between the output of the operational amplifier 11 and the gate of the current modulator M so as to turn the latter on.

When a scan control voltage $V_{select}$ is applied to the gate of the first switch I1, the latter is turned on and the output voltage of the operational amplifier is applied to the gate of the modulator.

The address circuit may also include an additional switch I2 connected between the source of the modulator M and the inverting terminal (−) of the operational amplifier 11 in order to allow the latter to operate in feedback mode.

Advantageously, this second switch may also be controlled by the scan voltage $V_{select}$ applied to the row select electrode. In this case, the gate of the second switch I2 is connected to the gate of the first switch I1 and the second switch receives the scan control voltage $V_{select}$ in synchronism with the first switch I1.

This second switch I2 ensures the addressing security of an emitter. It prevents any appearance of a leakage current in another address circuit located in the same column as the emitter selected.

Preferably, the two switches I1, I2 and the modulator M are fabricated using TFT technology. These thin-film transistors may be fabricated in amorphous silicon or in polysilicon. The address structure comprising three TFT components and an operational amplifier is compatible with both of these technologies for fabricating TFT components.

To maintain the brightness over the duration of an image frame, the address circuit includes a storage capacitor C placed between the gate of the modulator M and its source. This capacitor makes it possible to keep the voltage on the gate electrode of the modulator M approximately constant over a time interval corresponding to the frame duration.

The address circuit may also include a compensating capacitor $C_c$ connected in parallel, via the first and second control switches I1 and I2, with the charging capacitor C in order to stabilize the circuit.

When scanning the pixels, the two control switches I1, I2 of the selected emitter are turned on and, thanks to the feedback of the operational amplifier, it is the data voltage $V_{data}$ applied to the non-inverting terminal (+) of the operational amplifier that is actually applied to the anode of the light emitter E.

After scanning the pixels, the modulator M operates in the saturation region and delivers a drain current proportional to the voltage stored in the storage capacitor C. Because of the voltage compensation carried out by the operational amplifier, the drain current is independent of the trip threshold voltage $V_{th}$ of the modulator M. Thus, the variations in threshold voltage from pixel to pixel of one and the same column have no influence on the current flowing through the light emitter of these pixels.

Figure 4:
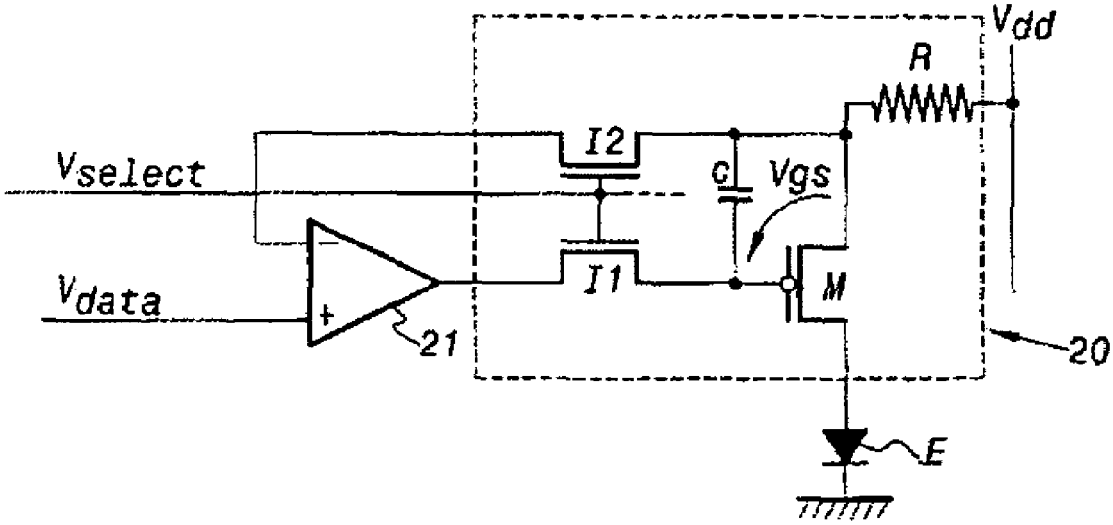
FIG. 4 is a schematic diagram of a second embodiment of the present invention in which the address circuit current modulator is of the p-type.

FIG. 4 shows a second embodiment of the present invention.

In the example shown, the modulator this time is of the p-type and the emitter is an OLED-type diode of conventional structure. The same circuit is also applicable to OLED displays of inverted structure provided that n-type modulators are used and provided that the modulator-emitter series is inverted, that is to say the anode of the emitters is connected to the supply electrode $V_{dd}$ and the source of the modulators to the earth electrode via a passive component.

Figure 3:
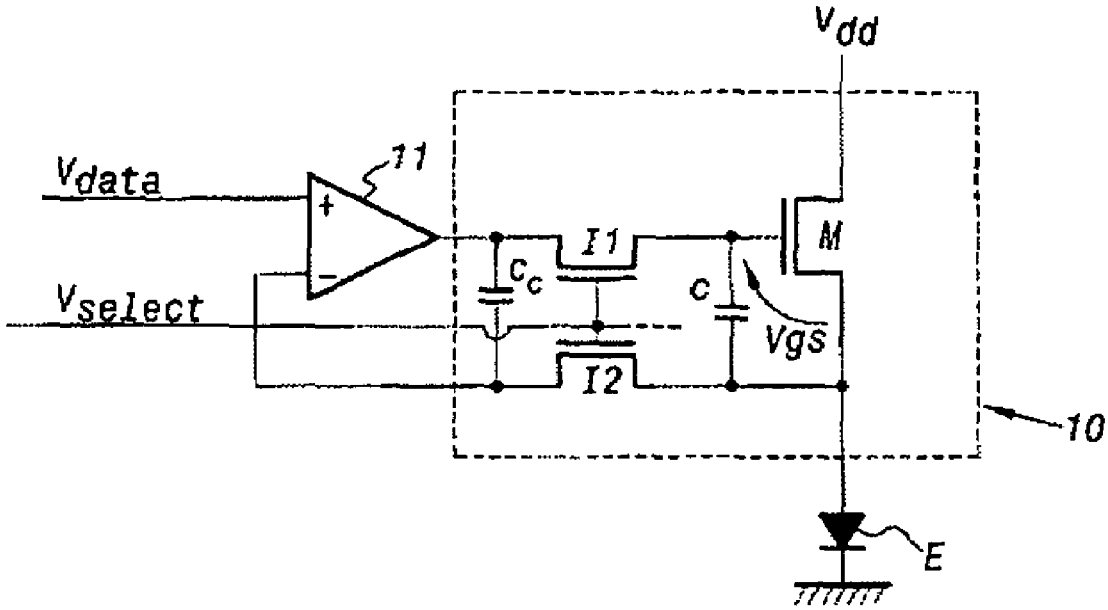
FIG. 3 is a schematic diagram of a first embodiment of the present invention in which the address circuit current modulator is of the n-type.

Like the first embodiment shown in FIG. 3, the operational amplifier 21 is employed in feedback mode. Its output is connected as previously to the gate of the modulator M via a control switch I1, and its inverting input (−) is connected as previously to the source of the modulator M via a control switch I2. As previously, the data control voltage $V_{data}$ is injected into the non-inverting input (+) of the amplifier.

Unlike the first embodiment, the supply voltage $V_{dd}$ for the emitter is connected here to the source of the modulator M via a passive component R. Since the modulator is of the p-type, the drain of the modulator is connected here to the anode of the light emitter E. When a data control voltage $V_{data}$ is applied to the gate of the p-type modulator, a drain current passes in this case through the modulator, from its source to its drain.

This passive component may, for example, comprise an electrode, a resistor, a diode or an electrical circuit. In the illustrative example shown in FIG. 4, this passive component advantageously consists of a thin-film resistor R.

When an emitter is selected, a data voltage $V_{data}$ is applied to the gate of the modulator M and therefore to the terminal common to the resistor R and to the source of the modulator, and a drain current flows through the modulator M and the emitter E. This current is defined according to the following linear law:

$$I_d=(V_{dd}-V_{data})/R \quad \text{(Equation 1).}$$

This is therefore here a current generator controlled by the data voltage $V_{data}$ on the basis of a fixed load R. Because of this fixed load, the emitters may advantageously be driven completely independently of the characteristics of the diodes or emitters E.

It may be demonstrated that the current flowing through the modulator and the emitter E is independent of its trip threshold voltage. In addition, since the circuit supply voltage $V_{dd}$ is constant, the drain current is directly controllable by the data voltage $V_{data}$. For a fixed data control voltage, the drain current is therefore constant.

Moreover, as described above, after the pixels have been scanned, the modulator M is in its saturation operating mode and the drain current is defined by the following equation:

$$I_d = k/2.W/I\,(V_{gs} - V_{th})^2 \quad \text{(Equation 2).}$$

For a fixed data voltage, the drain current $I_d$ is constant (cf Equation 1) and the difference between the trip threshold voltage $V_{th}$ and the gate-source voltage is therefore constant.

Thus, thanks to the feedback of the operational amplifier, the trip threshold voltage $V_{th}$ and the gate-source voltage are permanently adjusted one with respect to the other.

Consequently, the drain current does not vary with the trip threshold voltage of the various p-type transistors. The variation from pixel to pixel no longer has an effect on the current flowing through the light emitter.

Figure 5:
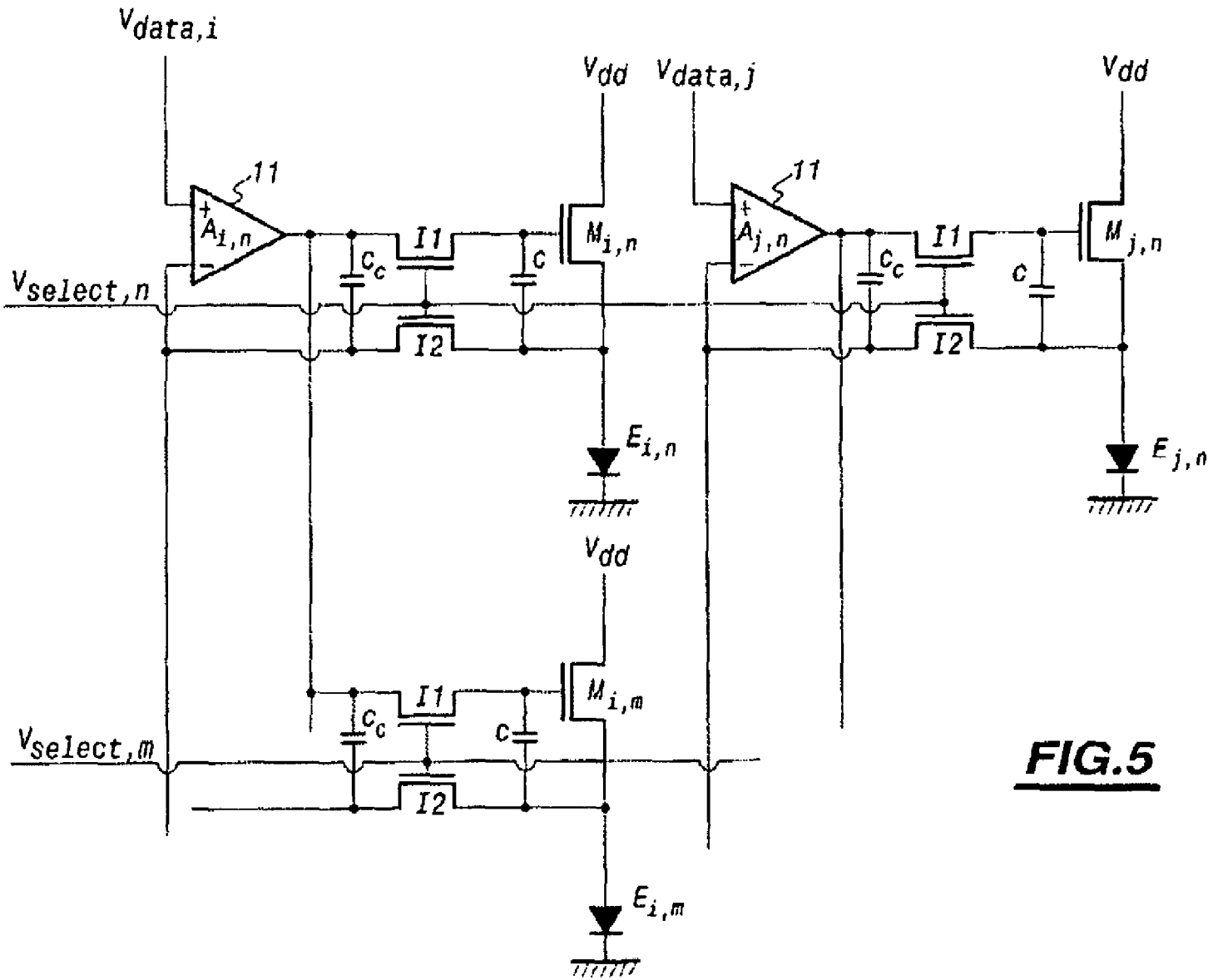
FIG. 5 is a schematic diagram of part of an array of emitters according to the first embodiment of the invention.

FIG. 5 shows schematically one part of an array of emitters of an active-matrix display panel in which the address circuit modulators are n-type components.

Conventionally, in such a display panel, the array of emitters and their address circuit are arranged in rows and columns.

Advantageously, applying a scan voltage $V_{select,n}$ to the electrode of row n controls all the first I1 and second I2 control switches for the pixels of this row.

Video data voltages, $V_{data,i}$ and $V_{data,j}$ corresponding to the images to be displayed supply the operational amplifiers of the columns via the column electrodes.

Advantageously, the array of emitters, shown in FIG. 5, includes only a single operational amplifier per column. This operational amplifier $A_{in}$ is capable of compensating for the various trip threshold voltages of each of the modulators $M_{in}$, $M_{im}$ of this column.

When each row of the array of emitters is being scanned, which scan corresponds to an image frame, the operational amplifiers $A_{in}$, $A_{jn}$ of the various columns of the display panel will simultaneously compensate for the trip threshold voltages of all the modulators of this row.

The output of the operational amplifier of a column is connected to the gate of each of the modulators of this column, via the first control switches I1. The inverting input (−) of the operational amplifier of this column is connected to the source of each of the modulators of this column, via the second control switches I2.

To select an emitter $E_{in}$, a select voltage $V_{select,n}$ is applied to the row electrode of row n of this emitter $E_{in}$ and, to obtain the desired emission, a data voltage $V_{data,i}$ is then applied to the electrode of column i of the column of this emitter $E_{in}$.

With the first I1 and second I2 control switches turned on, as explained above, the data control voltage $V_{data,i}$ is applied to the source of the modulator $M_{in}$. The trip threshold voltage of this modulator is compensated for by the output of the column amplifier $A_{in}$ and the modulator $M_{in}$ emits a drain current into the emitter $E_{in}$.

Since the panel or array of emitters comprises only a single operational amplifier per column in order to compensate for the threshold voltage variations, and since each pixel of this panel comprises only three transistors, an inexpensive panel is obtained that offers very uniform luminance levels and very good visual comfort.

The invention claimed is:

1. Active-matrix image display device comprising:

several light emitters forming an array of emitters distributed in rows and in columns, means for controlling the emission of the light emitters of the array, comprising:

for each light emitter of the array, a current modulator capable of controlling the said emitter, and comprising a source electrode, a drain electrode, a gate electrode and a trip threshold voltage, column address means capable of addressing the emitters of each column of emitters by applying a data voltage to the gate electrode of their modulators in order to control them, row select means capable of selecting the emitters of each row of emitters by applying a select voltage, compensation means for compensating for the trip threshold voltage of each modulator, wherein:

the compensation means comprise at least one operational amplifier, having an inverting input, a non-inverting input and an output terminal, and wherein:

the non-inverting input of the operational amplifier is connected to a column address means controlling the said modulator, and the inverting input of the operational amplifier is connected to the source electrode of the said modulator, and the output of the operational amplifier being connected to the gate electrode of the said modulator, the said connections of the inverting input and of the output of this operational amplifier thus forming a feedback capable of compensating for the trip threshold voltage of the said modulator.

2. Image display device according to claim 1, wherein the control means comprise, for the said modulator associated with an emitter, at least a first control switch connected between the output of the operational amplifier and the gate electrode of the said modulator, the first switch having a gate electrode capable of receiving the row select voltage for this emitter.

3. Image display device according to claim 2, wherein the control means comprise, for the said modulator associated with an emitter, a second control switch connected between the inverting terminal of the operational amplifier and the source electrode of the modulator, the second switch having a gate electrode connected to the gate electrode of the said first switch in order to receive, synchronously, the select voltage.

4. Image display device according to claim 2, wherein the row select means are capable of supplying a gate electrode of at least one of the said first switches in order to select at least one emitter in this row.

5. Image display device according to claim 3, wherein the modulators and the first and second control switches are components fabricated in thin-film polysilicon or thin-film amorphous silicon.

6. Image display device according to claim 5, wherein the modulators are p-type transistors and wherein the control means furthermore include a passive component placed between the source and a supply electrode of the modulator.

7. Image display device according to claim 1, wherein the operational amplifier is capable of compensating for the trip threshold voltage of all of the modulators controlling the emitters of a column.

8. Image display device according to claim 1, wherein the modulators are n-type transistors and in that their drain is supplied by a supply means.

9. Image display device according to claim 1, wherein each emitter is an organic light-emitting diode.

* * * * *